US009856738B2

(12) United States Patent
Ahmad et al.

(10) Patent No.: US 9,856,738 B2
(45) Date of Patent: Jan. 2, 2018

(54) TURBINE GUIDE VANE WITH A THROTTLE ELEMENT

(71) Applicant: Siemens Aktiengesellschaft, Munich (DE)

(72) Inventors: Fathi Ahmad, Kaarst (DE); Nihal Kurt, Dusseldorf (DE); Mario Nitsche, Borgsdorf (DE); Marco Schuler, Essen (DE); Andreas Varnholt, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 462 days.

(21) Appl. No.: 14/376,428

(22) PCT Filed: Dec. 12, 2012

(86) PCT No.: PCT/EP2012/075256

§ 371 (c)(1),
(2) Date: Aug. 3, 2014

(87) PCT Pub. No.: WO2013/120560

PCT Pub. Date: Aug. 22, 2013

(65) Prior Publication Data

US 2014/0377058 A1 Dec. 25, 2014

(30) Foreign Application Priority Data

Feb. 14, 2012 (EP) ..... 12155394

(51) Int. Cl.
*F01D 5/18* (2006.01)
*F01D 9/02* (2006.01)

(52) U.S. Cl.
CPC ..... *F01D 5/188* (2013.01); *F01D 5/187* (2013.01); *F01D 9/02* (2013.01); *F05D 2250/185* (2013.01); *F05D 2260/221* (2013.01)

(58) Field of Classification Search
CPC ... F01D 9/06; F01D 9/065; F01D 5/18; F01D 5/187; F01D 5/188; F01D 25/08; F01D 25/12
See application file for complete search history.

(56) References Cited

U.S. PATENT DOCUMENTS 4,456,428 A * 6/1984 Cuvillier ..... F01D 5/187 415/115
4,526,512 A 7/1985 Hook
(Continued)

FOREIGN PATENT DOCUMENTS

CN 87101766 A 10/1987
CN 87101971 A 11/1987
(Continued)

OTHER PUBLICATIONS

JP Notice of Allowance dated Aug. 8, 2016, for JP application No. 2014555956.
(Continued)

*Primary Examiner* — Gregory Anderson
*Assistant Examiner* — Cameron Corday
(74) *Attorney, Agent, or Firm* — Beusse Wolter Sanks & Maire

(57) ABSTRACT

A turbine guide vane having an aerodynamically bent vane airfoil with a channel system equipped with a throttle element is provided herein. The channel system includes channel sections for the guidance of coolant. In order to provide an alternative turbine guide vane by means of which both a partial coolant flow flowing in the interior and a partial coolant flow guided out of the turbine guide vane are adjustable; therefore, in an embodiment, the throttle element is designed for the removal of coolant.

5 Claims, 2 Drawing Sheets

(56) References Cited

U.S. PATENT DOCUMENTS

| | | | | |
|---|---|---|---|---|
| 4,666,368 | A | 5/1987 | Hook, Jr. et al. | |
| 4,818,178 | A | 4/1989 | Sibbertsen | |
| 6,631,561 | B1 * | 10/2003 | Anding | F01D 5/18 29/889.72 |
| 7,185,662 | B2 * | 3/2007 | Succop | B23P 6/002 134/1 |
| 8,801,366 | B2 | 8/2014 | Dueckershoff et al. | |
| 2007/0154312 | A1 * | 7/2007 | Neuhoff | F01D 5/187 416/97 R |
| 2009/0185893 | A1 | 7/2009 | Propheter-Hinckley | |
| 2011/0103932 | A1 * | 5/2011 | Dueckershoff | F01D 5/187 415/115 |

FOREIGN PATENT DOCUMENTS

| | | | |
|---|---|---|---|
| EP | 1099825 | A | 5/2001 |
| EP | 1099825 | A1 | 5/2001 |
| JP | S57153903 | A | 9/1982 |
| JP | H09303103 | A | 11/1997 |
| JP | H10306701 | A | 11/1998 |
| JP | 2003515024 | A | 4/2003 |
| JP | 2011515618 | A | 5/2011 |
| RU | 2159335 | C1 | 11/2000 |
| RU | 2387846 | C1 | 4/2010 |
| WO | 0136790 | A1 | 5/2001 |
| WO | 2009118245 | A1 | 10/2009 |

OTHER PUBLICATIONS

RU Notice of Allowance dated Dec. 5, 2016, for RU patent application No. 2014136803.

* cited by examiner

TURBINE GUIDE VANE WITH A THROTTLE ELEMENT

CROSS REFERENCE TO RELATED APPLICATIONS

This application is the U.S. National Stage of International Application No. PCT/EP2012/075256 filed Dec. 12, 2012, and claims the benefit thereof. The International Application claims the benefit of European Application No. EP12155394 filed Feb. 14, 2012. All of the applications are incorporated by reference herein in their entirety.

FIELD OF INVENTION

The invention relates to a turbine guide vane with an aerodynamically curved vane airfoil, which has a system of channels comprising channel sections for conducting coolant and equipped with a throttle element.

BACKGROUND OF INVENTION

Such a turbine vane is known for example from WO 01/36790 A1. The throttling of the cooling air consumption of the known turbine vane takes place with the aid of a plug, which is provided in the turbine guide vane from the outside, at a point of reversal of the cooling channel. Depending on the depth of penetration of the plug, the cross section of the point of reversal through which flow can pass, and consequently the throughflow of cooling air, can be set to a predetermined degree in a simple manner. Casting-dependent dimensional differences that result from the production of the turbine vane can be compensated with the aid of the plug, whereby excessive consumption of cooling air can be avoided.

Furthermore, it is known that, instead of a throttle, an opening may also be situated at the point of reversal for the removal of cooling air. In this case, the use of a throttle has not so far been possible at this position.

SUMMARY OF INVENTION

An object of the invention is to provide an alternative turbine guide vane with which subsequent throttling is possible in spite of an opening being present at the point of reversal for conducting coolant out from the turbine vane.

An object directed at the turbine guide vane is achieved by such a vane according to the features of the independent claims. Advantageous designs are specified in the subclaims. Its features may be combined with one another in any way desired.

An embodiment of the invention is based on the realization that, in the case of a turbine guide vane with an aerodynamically curved vane airfoil, which has a system of channels comprising channel sections for conducting coolant and equipped with a throttle element, the throttle element should be designed in such a way that it also allows the removal of coolant. Consequently, it should be equipped with an inflow opening, an outflow opening and a channel connecting the two openings. To this extent, the throttle element thus serves not just for throttling. It is at the same time also used as a diverter for dividing the coolant into two separate partial streams of coolant. The first of the two partial streams of coolant flows further within the turbine guide vane and is used for cooling the vane airfoil and the trailing edge thereof. The other of the two partial streams of coolant is conducted directly out from the turbine guide vane. The latter is of advantage in particular when further gas turbine components that either have to be cooled or with which the turbine guide vane (or other components) form gaps into which a hot gas of the gas turbine could penetrate are arranged at that end at which the coolant is conducted out from the turbine guide vane. By providing the coolant at these gas turbine components, the gaps concerned are blocked by coolant flowing out, so that the penetration of hot gas can be avoided with certainty. Both the cooling of the further gas turbine components and the blocking of the gaps to prevent hot gas from being drawn in prevent premature aging of the components as a result of inadmissibly high material temperatures, and consequently prolong their service life.

According to a first advantageous development, the throttle element is fitted in the turbine guide vane and is designed in the form of a cup with a circumferentially arranged inflow opening for coolant, the cup opening of the throttle element being arranged in the outer surface of the turbine guide vane. In this case, the cup opening represents the outflow opening for the partial stream of coolant flowing into the throttle element. With the aid of this design, a comparatively simple construction of a flow diverter is provided, the other of the two partial streams of coolant being produced by the incoming coolant flow flowing past the throttle element—to be more precise past the inflow opening of the throttle element—and continuing into the downstream channel sections of the system of channels. A further advantage of this construction is that the division of the incoming coolant flow into two partial streams can take place with a single component fitted into the cast turbine guide vane—the throttle element. The division of the stream of coolant depends on the size of the outflow opening and on the remaining throughflow cross section at the throttling point in the system of channels.

This design has the further advantage that operationally stressed turbine guide vanes already existing in the field can be equipped with such a throttling device, if appropriate retrofitted, without the turbine guide vanes having to be machined, modified or prepared for this purpose.

Moreover, the cup opening may also have a collar, the diameter of which is greater than the opening in which the throttle element is fitted. This prevents the throttle element from being able to fall into the channel sections, and thus be lost, when it is fitted.

The turbine guide vane is usually a cast component that is to the greatest extent or completely of a monolithic design. The turbine guide vane expediently comprises a root region and a head region for fastening. The two regions are arranged at the two ends of the vane airfoil. The throttle element may be arranged in the root region and/or in the head region. The root region of the turbine guide vane serves for the fastening of the turbine guide vane to an annular guide vane carrier. Extending radially inwardly from the root region is the vane airfoil, the inner end of which is adjoined by the head region. The root region and the head region generally each comprise what is known as a platform for the local, radial delimitation of the hot gas channel of the gas turbine. Provided on the side of the inner platform that is facing away from the hot gas channel are hooks, which are part of the head region and to which a ring known as a U ring is generally fastened. With this U ring, the turbine guide vanes or else turbine guide vane segments of a guide vane ring of the gas turbine are coupled to one another. Since these U rings may possibly have to be cooled and the gaps formed by these components with the rotor have to be blocked to prevent penetration of hot gas, it is of particular advantage if the coolant that is usually conducted through the turbine guide vane can be removed again at the head-side end of the turbine guide vane by the throttle element and used there on the hub side.

Also advantageous is that development in which two cooling channel sections arranged approximately parallel in relation to one another are connected to one another in terms of flow in the vane airfoil by way of a deflecting region arranged on the root side or on the head side and the throttle element protrudes into the deflecting region transversely with respect to the local throughflow direction of the coolant in said deflecting region. In this case there is between the two channel sections arranged parallel to one another a separating wall, which ends at the deflecting region, so that, depending on the depth of penetration, the throttle element can end closer to or further away from the end of this separating wall. To this extent, said separating wall is part of the throttling device, so that elements that are already present in a turbine guide vane assume a further function, for which they were not originally intended, if the throttle element is retrofitted. Coolant can be removed by the throttle element with little loss of pressure if the inflow opening is facing the incoming coolant flow.

In order to avoid areas known as dead water areas in the coolant flow or in the system of channels directly downstream from the throttle element, and consequently poorly cooled vane walls, it is preferably provided that at least one further circumferentially arranged throughflow opening is provided in the throttle element. In this case, the cross-sectional area of all the throughflow openings is preferably significantly smaller than the cross-sectional area of the inflow opening. The throughflow openings preferably lie opposite the inflow opening, and consequently on that side of the throttle element on which the partial stream of coolant that initially remains in the turbine guide vane flows away. It is even conceivable that such throughflow openings themselves are situated in the throttle element if the latter is not designed for the removal of cooling air—that is to say is not of a tubular design—but is of a solid design.

It is unimportant for the invention whether the feeding of coolant takes place here on the root side or on the head side. However, in one embodiment the throttle element is arranged in that region that is opposite from the feed.

BRIEF DESCRIPTION OF THE DRAWINGS

Further advantages and features of the invention are explained in more detail on the basis of the drawing that follows, in which.

DETAILED DESCRIPTION OF INVENTION

Figure 1:
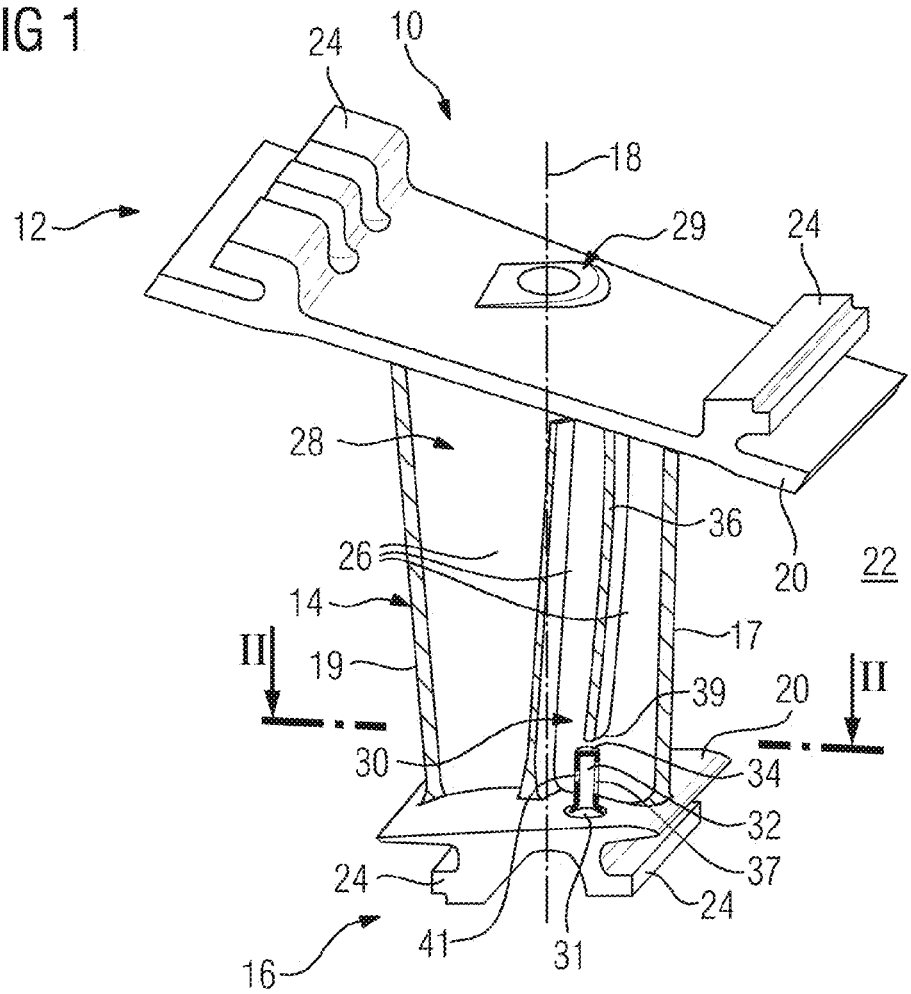
FIG. 1 shows a turbine guide vane in a perspective representation with a cut-open vane airfoil and a throttle element fitted on the head side and FIG. 2 shows a hub-side cross section through the vane airfoil of the turbine guide vane with the throttle element located therein.

A turbine guide vane 10 for a stationary gas turbine is perspectively represented in FIG. 1. The turbine guide vane 10 comprises a root region 12, an aerodynamically curved main airfoil 14 and a head region 16, which follow one another along a longitudinal axis 18. In the fitted position in a gas turbine, the root region 12 is situated radially on the outside and the head region 16 is situated radially on the inside. Both the root region 12 and the head region 16 each comprises a platform 20, respectively forming the local, radial delimitation of the annular hot gas path of the gas turbine in the region of the turbine guide vane 10 concerned. To this extent, the vane airfoil 14 extends through the annular hot gas channel 22. Both the root region 12 and the head region 16 have on their sides facing away from the hot gas channel 22 a number of hooks 24 for fastening. The hooks 24 provided at the root region 12 serve for fastening the turbine guide vane 10 to an annular turbine guide vane carrier that is not represented. On the other hand, the hooks situated in the head region 16 serve for fastening a ring known as a U ring, which is also not represented any further here.

Figure 2:
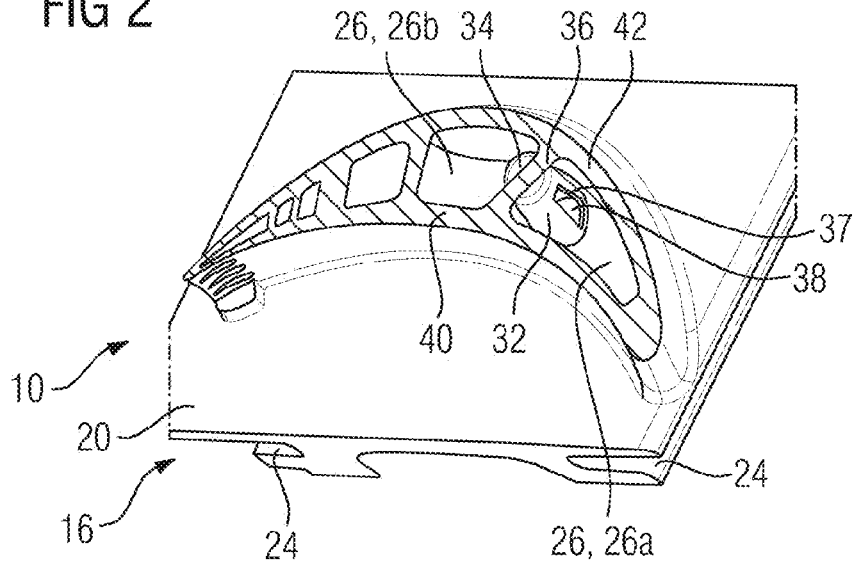
Figure 3:
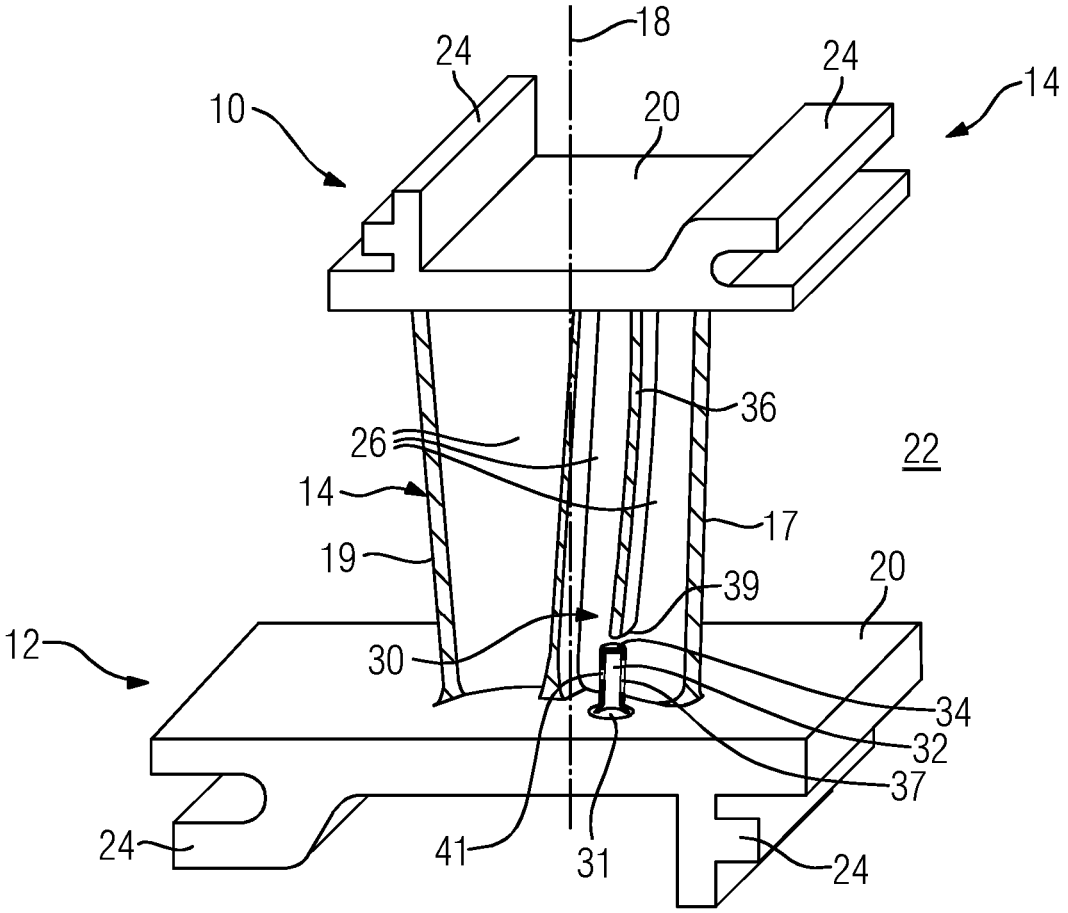
FIG. 3 shows a turbine guide vane in a perspective representation with a cut-open vane airfoil and a throttle element fitted on the root side.

The vane airfoil 14 comprises a leading edge 17 and a trailing edge 19, between which there extend a pressure-side vane airfoil wall 40 and a suction-side vane airfoil wall 42. The vane airfoil 14 represented in FIG. 1 is not shown completely perspectively, but partly in longitudinal section. As a result, the channel sections 26 of a system of channels 28 that are present in the interior of the vane airfoil 14 are represented. Consequently, the system of channels 28 with the channel sections 26 is arranged between the two walls 40, 42 (FIG. 2). The system of channels 28 is designed for conducting coolant, which can be fed to the turbine guide vane 10 via an opening 29 arranged on the root side. In the embodiment shown, three channel sections 26 arranged parallel to one another are provided, two of which are connected to one another in terms of flow at the head region by way of a deflecting region 30. In this deflecting region 30, the turbine guide vane 10 has an opening 31, in which a throttle element 32 is inserted from the outside. In order to secure the turbine guide vane 10 against losing the throttle element, the throttle element 32 may be welded or brazed to the cast turbine guide vane 10 at isolated points or else around the periphery.

The throttle element 32 is in the form of a cup, with a cylindrical casing and a cup base 34, which lies opposite a separating wall 36 separating the two channel sections 26, thereby forming a gap.

Identical features are provided with the same designations in all of the figures. Consequently, FIG. 2 shows the turbine guide vane 10 according to section II-II in FIG. 1 with the head region 16 and the hooks 24 arranged thereupon in a perspective representation. The throttle element 32 fitted into the turbine guide vane 10 from the outside on the head side is perspectively represented and has an inflow opening 37, which is facing one (26*a*) of the channel sections 26. Through the inflow opening 37, a cup opening 38 can be seen. The cup base 34 lies opposite the head-side end 39 (FIG. 1) of the separating wall 36, thereby forming a gap.

In the exemplary embodiment shown, the throttle element 32 is formed cylindrically with a constant diameter. The throttle element may also be designed cylindrically with diameters differing from section to section or may have a conically shaped design.

The inner surfaces of the vane airfoil walls 40, 42 are spaced apart laterally from the throttle element 32, so that the incoming coolant flow from the channel section 26*a*, usually cooling air, flows either into the inflow opening 37 or into the gaps between the inner surfaces of the vane walls or the separating wall 36 and the throttle element 32 for being divided into two streams of cooling air. The latter partial stream subsequently flows through the channel section 26*b* and remains initially in the turbine guide vane 10. The partial stream flowing into the inflow opening 37 flows out through the cup opening 38 and can be used on the hub side for cooling the components situated there or for blocking gaps to prevent hot gas from being drawn in.

To avoid coolant flow areas with a low flow rate, one or more throughflow openings 41 may also be provided in the throttle element.

It is of particular advantage that, with the aid of the throttle element 32, the entire amount of cooling air of the turbine guide vane 10 on the one hand and the ratio of the division of the two partial streams of coolant on the other hand can be set, even after the turbine guide vane 10 has been cast. By saving cooling air, a gas turbine equipped with the turbine guide vanes 10 according to the invention has an improved efficiency. At the same time, it is possible to retrofit already operationally stressed turbine guide vanes 10 with a throttle element 32 without any need in principle for them to be machined, as long as the turbine guide vane 10 has an opening for the removal of coolant flowing in it. It is also possible with the aid of the throttle element 32 to make turbine guide vanes 10 that are as new but do not conform to specifications fit for use in a gas turbine. This allows the reject rate of components to be reduced, which minimizes costs.

Altogether, embodiments of the invention relate to a turbine guide vane 10 with an aerodynamically curved vane airfoil 14, which has a system of channels 28 comprising channel sections 26 for conducting coolant and equipped with a throttle element 32. In order to provide an alternative turbine guide vane 10, with which both a partial stream of coolant flowing in the interior and a partial stream of coolant conducted out again from the turbine guide vane 10 can be set, it is proposed that the throttle element 32 is designed for the removal of coolant.

The invention claimed is:

1. A turbine guide vane, comprising:

an aerodynamically curved vane airfoil comprising a system of channels, said system of channels comprising channel sections for conducting a coolant and equipped with a throttle element, wherein the throttle element protrudes transversely into the system of channels thereby creating a throttling reduction in a cross sectional flow area in the system of channels, and wherein the throttle element is configured to provide a flow path from the system of channels, through the throttle element, to out of the turbine guide vane, wherein the throttle element is designed for removal of the coolant, wherein the throttle element is fitted in the turbine guide vane and is designed in a form of a cup comprising a cylindrical wall that protrudes transversely into the system of channels, a base at an end of the cylindrical wall, an inflow opening disposed in the cylindrical wall and in the system of channels for the coolant, and a cup opening arranged in an outer surface of the turbine guide vane, wherein the inflow opening defines an inlet for the flow path, and wherein the throttle element further comprises at least one throughflow opening located in the cylindrical wall to face downstream with respect to a coolant flow flowing in the system of channels during operation.

2. The turbine guide vane as claimed in claim 1, further comprising a root region and a head region for fastening, the root and head regions being arranged at respective ends of the vane airfoil, wherein the throttle element is arranged at least in the root region or in the head region.

3. The turbine guide vane as claimed in claim 1, wherein two adjacent channel sections arranged approximately parallel to one another and are connected to one another in terms of flow in the vane airfoil by way of a deflecting region of the system of channels arranged on a root side or on a head side, and wherein the throttle element protrudes transversely into the deflecting region.

4. The turbine guide vane as claimed in claim 1, wherein the inflow opening is located in the cylindrical wall to face upstream with respect to an incoming coolant flow flowing in the system of channels during operation.

5. A turbine guide vane, comprising:

an aerodynamically curved vane airfoil comprising a system of channels, said system of channels comprising channel sections for conducting a coolant and equipped with a throttle element, wherein the throttle element is fitted in the turbine guide vane and is designed in a form of a cup comprising a cylindrical wall that protrudes transversely into the system of channels, a base at an end of the cylindrical wall, an inflow opening disposed in the cylindrical wall and in the system of channels for the coolant, a cup opening arranged in an outer surface of the turbine guide vane, and at least one throughflow opening located in the cylindrical wall to face downstream with respect to a coolant flow flowing in the system of channels during operation, wherein the throttle element is designed for removal of the coolant.

* * * * *